US008383179B2

(12) United States Patent
Gielen

(10) Patent No.: US 8,383,179 B2
(45) Date of Patent: Feb. 26, 2013

(54) SELF-HEATING CONTAINER FOR PREPARING A FRESH HOT DRINK

(76) Inventor: Vincent Stefan David Gielen, Eindhoven (NL)

( * ) Notice: Subject to any disclaimer, the term of this patent is extended or adjusted under 35 U.S.C. 154(b) by 605 days.

(21) Appl. No.: 12/527,830

(22) PCT Filed: Feb. 14, 2008

(86) PCT No.: PCT/NL2008/000041

§ 371 (c)(1),
(2), (4) Date: Sep. 14, 2009

(87) PCT Pub. No.: WO2008/103025

PCT Pub. Date: Aug. 28, 2008

(65) Prior Publication Data

US 2010/0119657 A1 May 13, 2010

(30) Foreign Application Priority Data

Feb. 19, 2007 (NL) ..... 1033425

(51) Int. Cl.
*B65D 81/34* (2006.01)
*B65B 29/02* (2006.01)

(52) U.S. Cl. ..... 426/394; 426/79; 426/77; 426/109; 426/115; 126/263.09; 126/263.08; 126/263.06; 126/263.05; 206/222; 99/323.3

(58) Field of Classification Search ..... 426/109, 426/115, 394, 77–79, 84; 99/323.3, 317–323; 126/263.01, 263.05, 263.06–263.09; 206/219–222
See application file for complete search history.

(56) References Cited

U.S. PATENT DOCUMENTS

| | | | | |
|---|---|---|---|---|
| 3,683,889 | A | 8/1972 | Hoffman | 126/263 |
| 4,773,389 | A * | 9/1988 | Hamasaki | 126/263.07 |
| 5,104,666 | A | 4/1992 | Sanvitale | 426/77 |
| 5,461,867 | A * | 10/1995 | Scudder et al. | 62/4 |
| 6,079,405 | A * | 6/2000 | Justo | 126/263.08 |
| 6,267,110 | B1 * | 7/2001 | Tenenboum et al. | 126/263.01 |
| 6,298,771 | B1 | 10/2001 | Calvento | 99/323 |
| 6,338,252 | B1 * | 1/2002 | Calderaio | 62/4 |
| 2004/0224057 | A1 | 11/2004 | Miller et al. | 426/119 |

FOREIGN PATENT DOCUMENTS

| | | |
|---|---|---|
| EP | 344541 | 12/1989 |
| EP | 1213227 | 6/2002 |
| ES | 2 055 662 | 8/1994 |
| FR | 2 847 241 | 5/2004 |
| WO | WO 93/15641 | 8/1993 |
| WO | WO 01/92128 | 12/2001 |

* cited by examiner

*Primary Examiner* — Drew Becker
*Assistant Examiner* — Luana Z Long
(74) *Attorney, Agent, or Firm* — Roberts & Roberts, LLP

(57) ABSTRACT

A self-heating container (1, 2) to prepare a fresh hot beverage containing a compartment containing a heat-delivering substance (8) to heat the liquid in the device, an airtight compartment (11) containing a measured amount of liquid to be heated, an airtight compartment containing a measured amount of dry matter for preparing a hot beverage, a filter (11) for separating the dry matter from the liquid (optional) and a compartment containing a measured amount of liquid to actuate the heat-delivering substance (8) with the attribute that the heat-delivering substance is actuated (13) simultaneously with the release of the dry matter to the compartment containing the measured amount of liquid to be heated during actuation.

14 Claims, 4 Drawing Sheets

SELF-HEATING CONTAINER FOR PREPARING A FRESH HOT DRINK

The present invention relates to a device and a method to quickly and with a minimum number of actions, prepare a fresh hot drink, for example, a fresh cup of coffee, for which the structure includes:

BACKGROUND OF THE INVENTION

- A first airtight compartment containing a heat-delivering substance to heat the liquid in the device;
- A second airtight compartment containing a measured amount of liquid to be heated;
- A third airtight compartment containing a measured amount of dry matter for preparing a hot drink:
- A filter for separating the dry matter from the liquid (optional);
- A fourth compartment containing a measured amount of liquid to actuate the heat-delivering substance.

Methods for preparing an individual quantity of hot drink are commonly known and generally include, in the most elementary form, a heat source which, when actuated, warms up a cold, premixed beverage. Such a device has the advantage that with a limited number of actions and at a low price, a warm drink can be prepared, e.g. premix coffee. Such a device has the disadvantage that organoleptic properties of the prepared drink are relatively poor.

The organoleptic properties can be improved by mixing with a warm liquid. WO 93/15641 describes a self-heating can with a heat source and a reservoir with a fluid to be heated. which is linked to a space containing a concentrate and a cup to receive the warm drink. Such a device includes as the elements to quickly prepare a hot drink with reasonable organoleptic properties. but has the disadvantage that the steam from the heating element creates a pressure difference inside the device, making it complex and expensive.

A further improvement of the organoleptic properties can be achieved through extraction of smell and flavours from a fine, powdered, dry substance, such as ground coffee, using a heated liquid. U.S. Pat. No. 6,298,771, for example, describes a device and method for making coffee from ground coffee beans placed in a filter through which a heated liquid is percolated under the influence of gravity.

The advantage of this device is that the ground coffee has a relatively long shelf life, and that a fresh cup of coffee can be made quickly. The disadvantage of such a device is that the process is laborious because the hot liquid should be added separately and therefore an external heat source is needed.

In addition to the organoleptic properties, ease of use is an important aspect for a device to prepare such a hot drink. The number of actions for a user to prepare such a warm drink must be minimal and should be in accordance with a unique instruction. presented on the package. A single location, e.g. a button, for actuation and a single orientation of the device with respect to a subsurface is preferable to multiple buttons actuation and orientations to a subsurface.

The heat source is preferably actuated at the top of the device and not at the bottom, such as known from EP 1213227, which describes a can for beverages which is equipped with an opening at the bottom, where a metal heating element is located. After actuation of the heating element the device has to be turned over before opening it at the top, for consumption. Such a device has the additional disadvantage that the user can make direct contact with the hot heating element and that the price is relatively high.

BRIEF SUMMARY OF THE INVENTION

The present invention aims at a device and operation of the kind mentioned in the preambles that, while maintaining the benefits of these devices, solves their disadvantages. For this the device is equipped with:

- A first airtight compartment containing a heat-delivering substance to heat the liquid in the device;
- A second airtight compartment that has a measured amount of liquid to be heated;
- A third airtight compartment containing a measured amount of dry matter for preparing a hot drink;
- A filter for separating the dry matter solids from the liquid (optional);
- A fourth compartment containing a measured amount of liquid to actuate the heat-delivering substance.

Secondly, the invention relates to a process for the preparation of a fresh, hot drink, which includes the following steps:

- Open or remove a seal which makes the actuation button accessible;
- Pressing the button for actuation.

In a preferred embodiment of the invention all compartments are sealed airtight with a foil so that the contents remains fresh and free of contamination. A measured amount of liquid is used allowing the design to be simple and give the device great ease of use, making it very suitable for the preparation of a hot beverage.

In a preferred embodiment of the invention the third compartment is filled with freshly ground coffee and sealed airtight with a foil. A filter is integrated in the holder in which the ground coffee falls after perforation of the foil so that fresh coffee can be prepared with very good organoleptic properties through absorption by heated water.

In a preferred embodiment of the invention the heating element is a closed compartment, which in a short time after actuation, releases an adequate amount of heat. Such a thermal element can, for example, contain an amount of calcium oxide, which is separated from a measured amount of water by means of a perforatable foil. By perforating this separation wall the calcium oxide is mixed with the water, forming calcium hydroxide, releasing reaction heat.

In a preferred embodiment of the invention, such a closed thermal element is in direct contact with a measured amount of liquid from which the hot drink is prepared and has a shaped exhaust through which steam can escape. After actuation of the element the reaction heat is released and absorbed by the liquid. Simultaneously the dry matter from the third compartment is brought into contact with the liquid to form the resulting hot drink, e.g. fresh coffee.

The invention also relates to a process for the preparation of a fresh, hot drink. Further details and advantages of the invention will become apparent from the following description with reference to the accompanying drawings, in which the invention is shown by way of example.

DETAILED DESCRIPTION OF THE INVENTION

Figure 1:
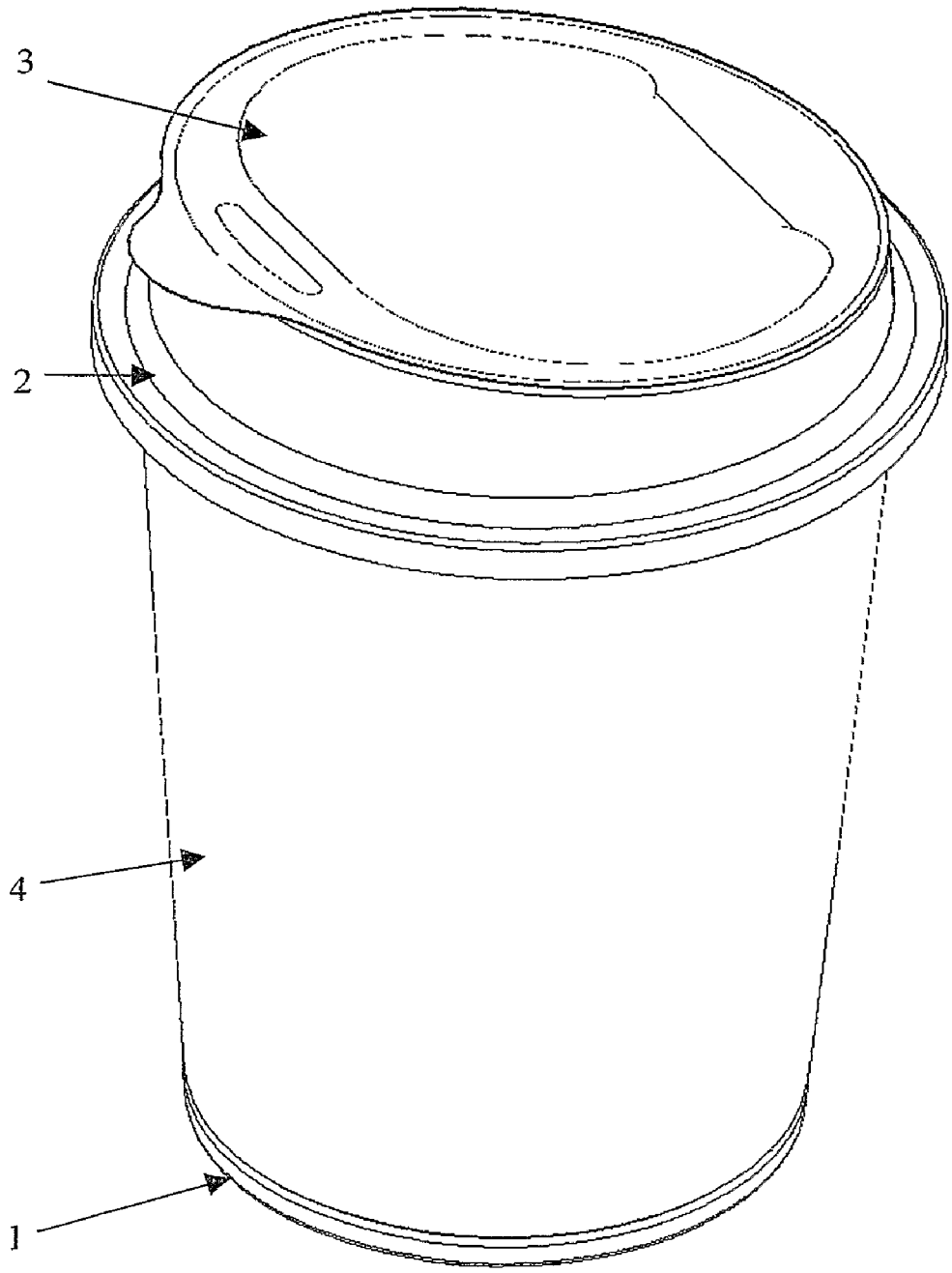
FIG. 1 is a perspective view of the device according to the invention.

FIG. 1 shows a cup (1) with a lid (2) with an airtight seal (3) and an insulating jacket (4). Prior to actuation, the lid (2) is sealed with an airtight foil (3), keeping the product fresh and to prevent misuse or unwanted actuation.

Figure 2:
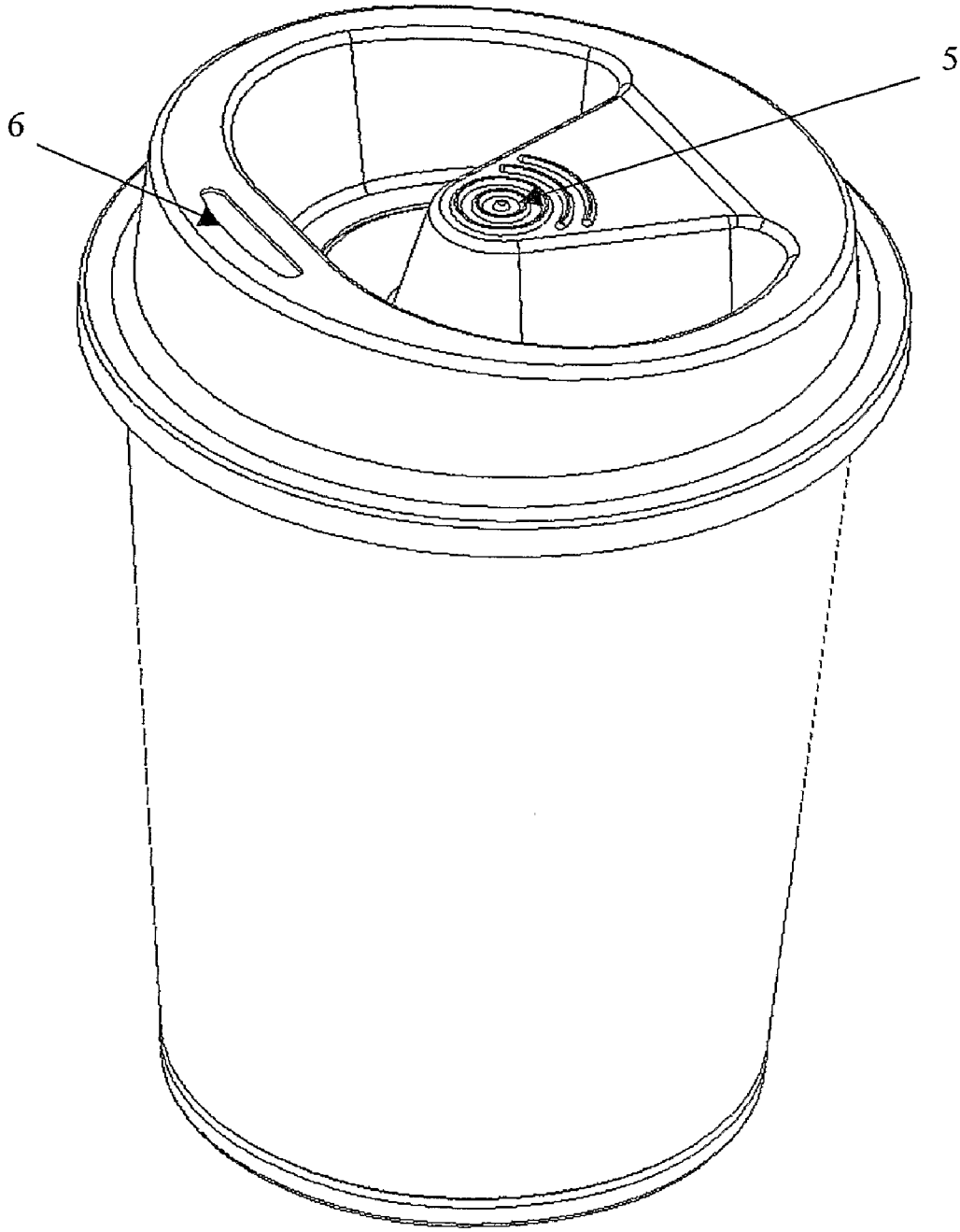
FIG. 2 is a perspective view of the device according to the invention, after removal of the top seal.

FIG. 2 shows the lid without the airtight seal. In the cover a push-button (5) and a drink opening (6) become visible and accessible after removal of the seal.

Figure 3:
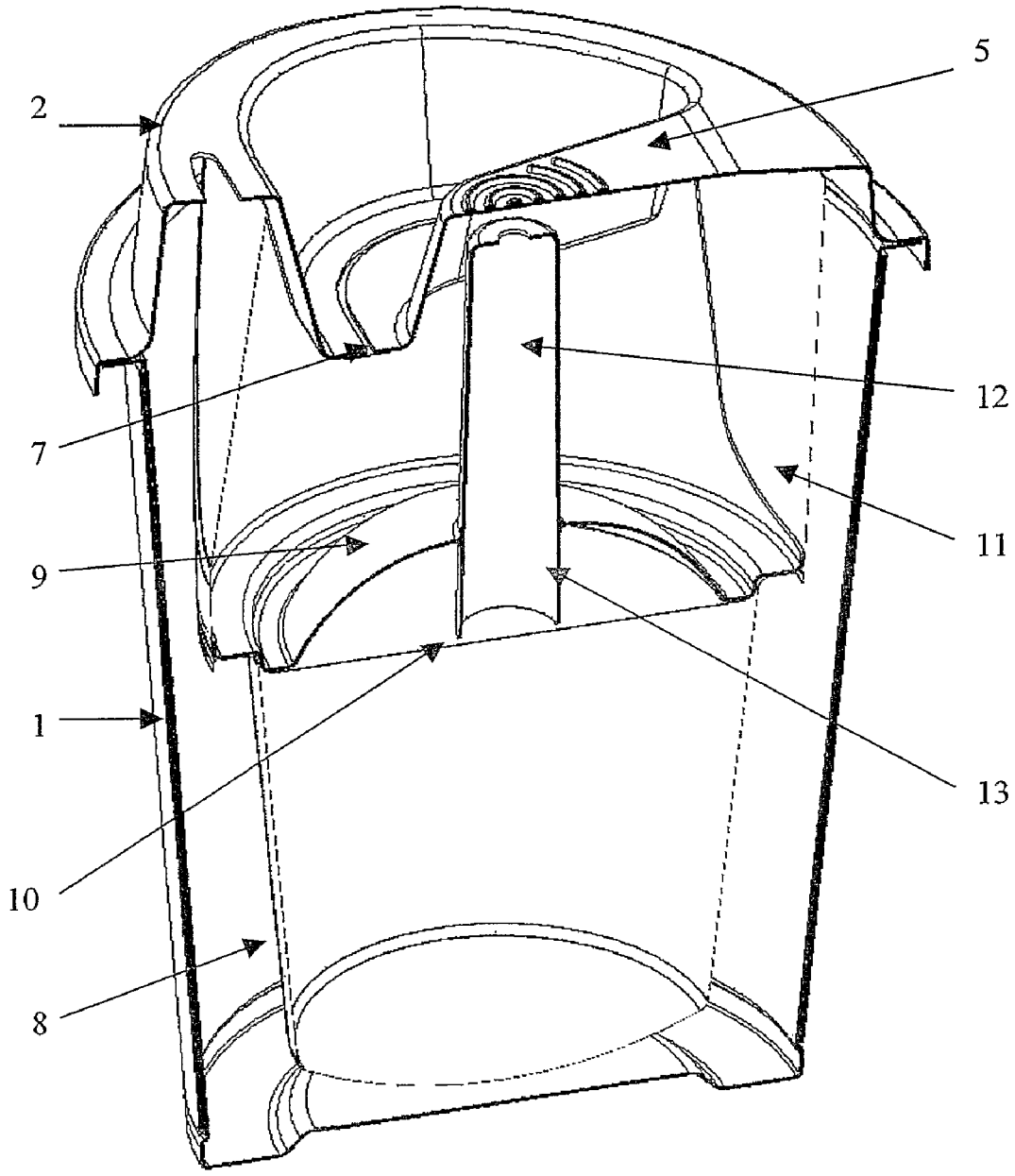
FIGS. 3 and 4 are section views of the device according to the invention.
Figure 4:
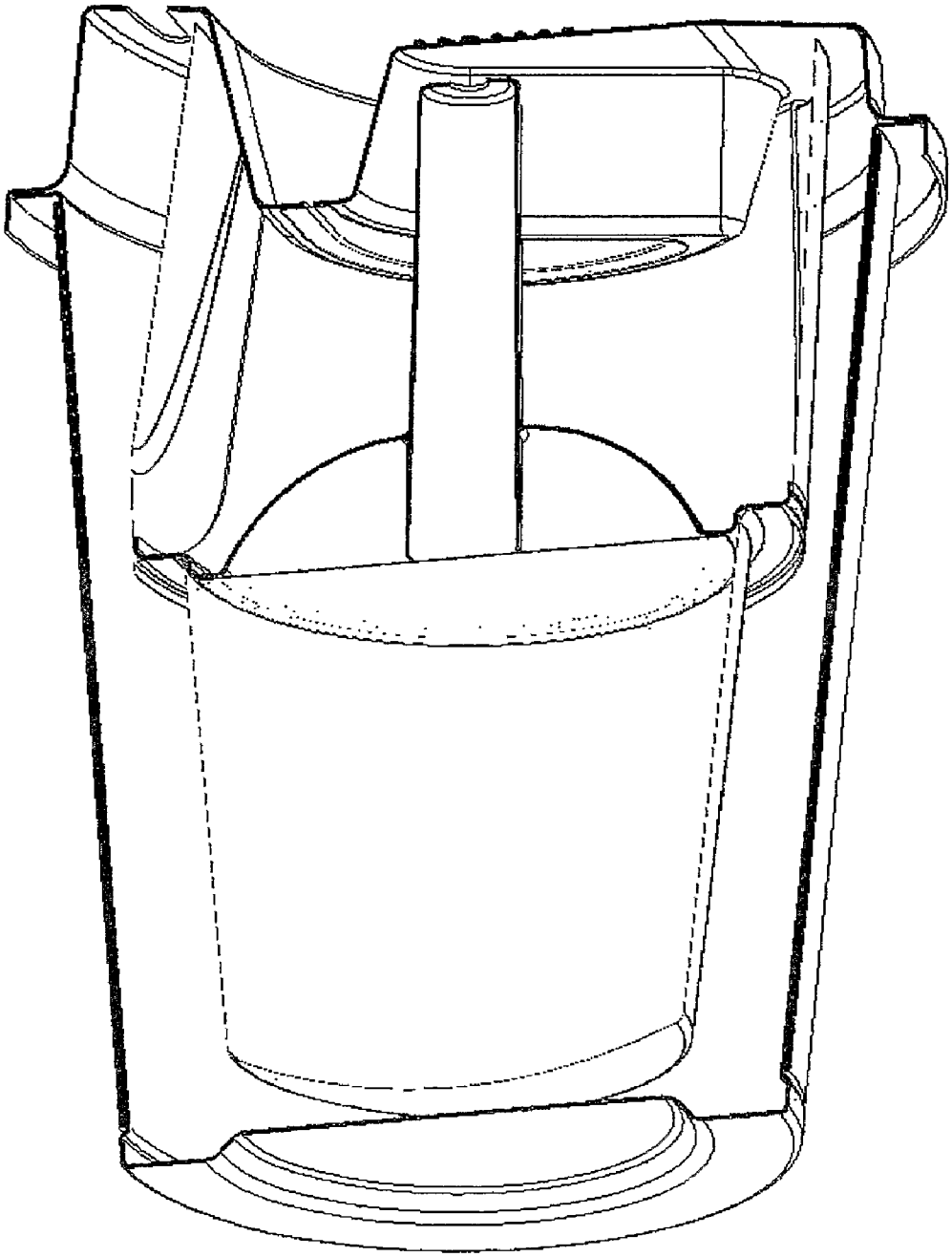

FIGS. 3 and 4 show the same cup in cross-section, which show an upper compartment between the pushbutton (5) and seal (7) in which the dry substance, e.g. ground coffee, is stored. The space between the cup (1) and the heating element (8) is the compartment for the liquid to be heated, e.g. water. The heating element (8) is completely immersed in the liquid, guaranteeing an intensive contact between liquid and element and preventing direct contact of the user with the heating element and hot steam released therefrom. The heating element is filled with a measured amount of calcium oxide that reacts with water to form calcium hydroxide releasing reaction heat. That water is situated in the fourth compartment in the heating element (8) between the element cover (9) and a seal (10). The element cover (9) is also the bottom of the filter (11), which is directly beneath the third compartment and also forms the connection between the cover (2) and the heating element (8). The center of the element cover (9) is an exhaust (12), which extends into the element perforator (13).

By pressing the button (5) the foil (7) will tear along a defined line, releasing the dry matter, e.g. ground coffee, into the filter (11), and the extraction process begins. At the same time, the force on the button is transmitted to the exhaust (12) through to the element perforator (13) tearing the seal (10) releasing the water from the fourth compartment, which in turn reacts with the calcium oxide in the heating element (8). The heating element heats up and gives off heat to water in the cup (1) by means of conduction. Convection of the heated water speeds up the extraction process. If necessary, the extraction process can be further stimulated by rotating the cup (1) horizontally. The exhaust (12) prevents solid, or liquid material escaping from the heating element (8). Steam from the reaction is vented through the exhaust (12). After about 5 minutes, the coffee is ready. Additives such as sweeteners and milk can be added through the opening in the lid (2) after perforation of foil (10) after which the coffee can be consumed through the drinking opening (6).

It is clear that the invention is not limited to the embodiment represented, but that many variations are possible. For example, a pump can be added to stimulate the extraction process or as a means of frothing Moreover, the filter (11) can have different mesh types, or the filter can be omitted entirely, in order to make the use of soluble dry matter possible, e.g. instant soup, instant chocolate drink, or instant coffee. The extraction process described above can also be used to make tea. In addition, alternative heating elements can be used, e.g. fine iron powder that can release oxidation heat, or saturated salt-solutions which can release crystallization heat. Such variations are apparent to professionals and are considered to be within the scope of the invention as expressed in the following claims.

The invention claimed is:

1. A self-heating container to prepare a fresh hot beverage, said container comprising a heating element therein, which container comprises a first compartment containing a heat-delivering substance to heat a liquid in the container, a second airtight compartment containing a measured amount of liquid to be heated, a third airtight compartment containing a measured amount of dry matter for preparing a hot beverage, an optional filter for separating the dry matter from the liquid in the second compartment, and a fourth compartment containing a measured amount of liquid to actuate the heat-delivering substance, wherein the heat-delivering substance is actuated simultaneously with a release of the dry matter into the second compartment containing the measured amount of liquid to be heated, which heating element comprises the first compartment containing the heat-delivering substance, the fourth compartment containing the measured amount of liquid, a heating element cover, a perforator which extends through the heating element cover, and an exhaust which extends into the perforator.

2. The self-heating container as set forth in claim 1 in which the liquid in which at least one of the second compartment and the fourth compartment comprises water.

3. The self-heating container as set forth in claim 2 in which the dry substance comprises ground coffee beans.

4. The self-heating container as set forth in claim 3 in which the heat-delivering substance comprises calcium oxide.

5. The self-heating container as set forth in claim 2 in which the heat-delivering substance comprises calcium oxide.

6. The self-heating container as set forth in claim 1 in which the dry substance comprises ground coffee beans.

7. The self-heating container as set forth in claim 6 in which the heat-delivering substance comprises calcium oxide.

8. The self-heating container as set forth in claim 1 in which the heat-delivering substance comprises calcium oxide.

9. The self-heating container as set forth in claim 1 wherein the filter is present.

10. The self-heating container as set forth in claim 1 wherein the filter is not present.

11. A method for preparing a fresh hot beverage comprising providing a self-heating container comprising a heating element therein, which container comprises a first compartment containing a heat-delivering substance to heat a liquid in the container, a second airtight compartment containing a measured amount of liquid to be heated, a third airtight compartment containing a measured amount of dry matter for preparing a hot beverage, an optional filter for separating the dry matter from the liquid in the second compartment, and a fourth compartment containing a measured amount of liquid to actuate the heat-delivering substance; and then actuating the heat-delivering substance simultaneously with a release of the dry matter into the second compartment containing the measured amount of liquid to be heated, which heating element comprises the first compartment containing the heat-delivering substance, the fourth compartment containing the measured amount of liquid, a heating element cover, and a perforator which extends through the heating element cover, and an exhaust which extends into the perforator.

12. The method as set forth in claim 11 in which the hot beverage is fresh coffee.

13. The method as set forth in claim 11 wherein the filter is present.

14. The method as set forth in claim 11 wherein the filter is not present.

* * * * *